US005837387A

United States Patent [19]

Brady et al.

[11] Patent Number: 5,837,387

[45] Date of Patent: Nov. 17, 1998

[54] TWO-PHASE (TIAL+TICRAL) COATING ALLOYS FOR TITANIUM ALUMNIDES

[75] Inventors: Michael P. Brady, Cleveland; James L. Smialek, Strongesville; William J. Brindley, North Royalton, all of Ohio

[73] Assignee: The United States of America as represented by the Administrator of the National Aeronautics and Space Administration, Washington, D.C.

[21] Appl. No.: 675,126

[22] Filed: Jul. 3, 1996

[51] Int. Cl.[6] ..... B32B 15/04; C22C 21/00; C22C 30/00; C22C 14/00

[52] U.S. Cl. ..... 428/650; 428/651; 428/654; 420/552; 420/580; 420/418

[58] Field of Search ..... 420/528, 552, 420/428, 580, 588, 417, 418, 421; 428/650, 651, 652, 654, 660, 663, 666

[56] References Cited

PUBLICATIONS

Brady et al. "Oxidation–Resistant TiAlCr Alloys Developed", Jul. 10, 1996, NASA Lewis Research and Technology, 1994, published Jul. 10, 1995.

Klansky et al. "Structure/property observaions for Al–Ti–Cr intermetallic alloys", J. Mater, Res., vol. 9, No. 2, Feb. 1994 pp. 255–257.

McCarron et al. "Protective Coatings for Titanium Aluminide Intermetallics", Titanium '92, Science and Technology, (no month) 1993, pp. 1971–1978.

McKee et al. "The Oxidation Behavior of Gamma–Titanium Aluminide Alloys Under Thermal Cycling Conditions", Corrosion Science, vol. 33, No. 12, pp. 1899–1914, 1992 (June).

Brady et al. "Microstructure/Oxidation/Microhardness Correlations in gamma–based and tau–based Al–Ti–Cr Alloys", Mat. Res. Soc. Symp. Proc., vol. 364, (no month) 1995, pp. 1309–1314.

Brady et al. "Microstructure of Alumina–Forming Oxidation Resistant Al–Ti–Cr Alloys", Scripta Metallurgica et Materialia, vol. 32, No. 10, pp. 1659–1664, (no month) 1995.

Brady et al., "Oxidation Mechanism of gamma+Laves Ti–Al–Cr Coating Alloys", 1995 NASA HITEMP Proceedings, Oct. 23, 1995, pp. 1–3.

Brady et al., "Microstructure/Property Correlations in Alumina Forming Al–Ti–Cr Alloys", 1994 NASA HITEMP Proceedings, Oct. 24, 1994, pp. 1–3.

*Primary Examiner*—John J. Zimmerman
*Assistant Examiner*—Michael LaVilla
*Attorney, Agent, or Firm*—Kent N. Stone

[57] ABSTRACT

A coating for protecting titanium aluminide alloys, including the TiAl $\gamma$+$Ti_3Al$ ($\alpha_2$) class, from oxidative attack and interstitial embrittlement at temperatures up to at least 1000° C. is disclosed. This protective coating consists essentially of titanium, aluminum, and chromium in the following approximate atomic ratio:

Ti(41.5–34.5)Al(49–53)Cr(9.5–12.5)

11 Claims, 7 Drawing Sheets

TWO-PHASE (TIAL+TICRAL) COATING ALLOYS FOR TITANIUM ALUMNIDES

ORIGIN OF THE INVENTION

The invention described herein was made in part by employees of the United States Government and may be manufactured and used for the Government for governmental purposes without the payment of any royalties thereon or therefore.

BACKGROUND OF THE INVENTION

1. Field of Invention

This invention pertains to the art of alloys of titanium and aluminum, and more specifically to a coating for titanium aluminides which protects them from oxidation and interstitial embrittlement at temperatures up to at least 1000° C. The coating is generally a titanium aluminide alloy having a Ti-Cr-Al Laves phase dispersed in a TiAl γ (gamma) phase matrix.

2. Description of the Related Art

Titanium aluminides are intermetallic compounds known to be candidate materials for use in advanced structural applications because they offer a desirable combination of low density and high temperature strength. In particular, substrates which are composites of TiAl (γ) and $Ti_3Al$ ($\alpha_2$) are being pursued in the art for high-temperature structural applications. However, these materials are currently limited to applications below approximately 700° C.–800° C. because of inadequate oxidation resistance. They are also susceptible to environmental embrittlement by interstitial diffusing species, which may severely degrade their mechanical properties and limit their use as structural materials.

In the art, it is known that providing a metallic substrate with a coating may serve to enhance a substrate's structural properties. Such coatings are required to provide sufficient oxidative resistance without degrading the substrate's structural properties because of brittleness, and chemical or thermal incompatibility.

There have been protective coatings proposed for TiAl (γ) substrates. For example, a chromium modified titanium aluminum alloy (Ti-Cr-Al) for use as a coating on a gamma alloy is discussed in a paper entitled "Protective Coatings for Titanium Aluminide Intermetallics" (R. L. McCarron, et al., Titanium 192, Science and Technology, pp 1971–1978, (1993)). The coatings discussed therein, however, are extremely brittle.

Another example, U.S. Pat. No. 5,149,497 discloses a titanium aluminum alloy modified by chromium (Cr) and tantalum (Ta). The alloys exhibit inferior oxidation resistance to the Ti-Al-Cr alloys of the present invention.

In general, none of the Ti-Al-Cr coating alloys known in the art provide the desired properties in temperature ranges up to 10000° C., especially when the desired substrate is a member of the gamma-alpha$_2$ ($\gamma+\alpha_2$) class of titanium aluminides. The Ti-Al-Cr coating alloys known in the art have been formulated to provide oxidation resistance without sufficient regard to alloy phase equilibria, microstructure, and mechanical properties. The known alloys which are Tau (τ) ($Ll_2$) or Ti-Cr-Al (Laves) based have shown themselves to be extremely brittle, chemically and/or thermally incompatible with gamma+alpha substrates, and microstructurally unstable over an intended temperature range of use (600° C.–1000° C).

The present invention is directed to two-phase Ti-Al-Cr alloys which address the shortcomings of prior art coatings, while providing better and more advantageous overall results.

SUMMARY OF THE INVENTION

In accordance with the practice of the present invention, alloys of Ti-Al-Cr are provided as coatings for titanium aluminide substrates to provide oxidative resistance and protect against interstitial embrittlement.

More particularly, in accordance with the invention, two-phase alloys for use as coatings which protect from oxidation and interstitial embrittlement are provided which are sufficiently tough, and are chemically and thermally compatible with ($\gamma-\alpha_2$) titanium aluminide substrates such as (Ti-47Al-2Cr-4Ta).

According to one aspect of the present invention, a chromium modified titanium aluminum alloy consists essentially of titanium, aluminum and chromium in the following approximate atomic ratio: Ti(41.5–34.5)Al(49–53)Cr(9.5–12.5).

According to another aspect of the present invention, a chromium modified titanium aluminum alloy consists essentially of titanium, aluminum and chromium in the following approximate atomic ratio:

Ti(36.50)Al(51.25)Cr(12.25).

According to another aspect of the present invention, a chromium modified titanium aluminum alloy comprises a volume fraction of TiAl (gamma) phase and a volume fraction of Ti-Cr-Al Laves phase wherein the volume fraction of TiAl is greater than 0.50.

According to another aspect of the present invention, the Laves phase is discontinuous within the gamma phase.

According to another aspect of the present invention, there is provided a coating for a substrate, the coating consisting essentially of titanium, aluminum, and chromium in the following approximate atomic ratio: Ti(41.5–34.5)Al (49–53)Cr(9.5–12.5).

According to another aspect of the invention, the substrate is a titanium aluminum alloy.

According to another aspect of the invention, the titanium aluminum alloys may include TiAl (γ) titanium aluminide, $Ti_3Al$ ($\alpha_2$) titanium aluminide, a composite of TiAl (γ)+ $Ti_3Al$ ($\alpha_2$), and $Ti_2AlNb$ orthorhombic phase alloys.

According to another aspect of the invention, the substrate is an alumina-based fiber.

According to another aspect of the invention, a composite structural article comprising a substrate and a coating for protecting the substrate from oxidative attack and interstitial embrittlement at temperatures up to at least 1000° C. is provided. The coating consists essentially of titanium, aluminum, and chromium in the following approximate atomic ratio: Ti(41.5–34.5)Al(49–53)Cr(9.5–12.5).

One advantage of the present invention is the reduced brittleness of the disclosed alloys.

Another advantage of the present invention is the compatibility with the $\gamma+\alpha_2$ class of titanium aluminide substrates.

Yet another advantage of the present invention is the performance of the coating in temperature ranges up to at least 1000° C.

Still other benefits and advantages of the invention will become apparent to those skilled in the art to which it pertains upon a reading and understanding of the following detailed specification.

BRIEF DESCRIPTION OF THE DRAWINGS

The detailed description of the invention which follows will be understood with greater clarity if reference is made to the accompanying drawings in which.

DETAILED DESCRIPTION OF THE INVENTION

Detailed analysis of previous attempts to develop coating alloys for use on titanium aluminides have led to the identification of multi-phase alloys consisting primarily of $\tau$ ($Ll_2$), TiAl ($\gamma$), and Ti-Cr-Al Laves phases. The oxidation resistance and alumina compatibility of the phases, individually and in combination, were evaluated. In addition, the mechanical properties of the phases were evaluated by room temperature microhardness measurements. Finally, the microstructural stability of the phases were evaluated.

In the oxidation resistant composition range of the Ti-Al-Cr systems, the Laves phase was determined to be the major source of brittleness. For instance, the Laves phase was observed to crack extensively under a 100 g/15 sec. Vicker's microhardness indentation load. However, the presence of the Laves phase was found to be necessary for oxidation resistance.

With reference to a paper entitled "Structure/Property Observations for Al-Ti-Cr Intermetallic Alloys" (J. L. Klansky, et al., J. Mater. Res.,9,p.255 (1994)), it is reported that mixing the $\tau$ ($Ll_2$) phase with the Laves phase can improve cracking resistance. However, it has been discovered that the $\tau$ phase was not stable at 800° C., but primarily decomposed to the brittle $TiAl_2$ form. Therefore, the potential benefits of the $\tau$ phase are lost when the alloy is exposed to high temperature ranges.

With regard to the $\gamma$ phase, it has been reported that the $\gamma$ phase is capable of limited room temperature ductility (S. C. Huang and E. L. Hall, Met. Trans. A, 22, p. 2619 (1991)). In addition, the reference to Klansky et al. reports that mixing a Laves phase (TiCrAl) with ($\gamma$) TiAl improves cracking resistance relative to single-phase Laves. However, the $\gamma$ phase is not sufficiently oxidation resistant.

In a multi-phase Ti-Al-Cr system, a region has been identified which exhibits oxidation resistant characteristics as well as crack resistance and compatibility with alumina. The region consists primarily of two phases: TiAl (gamma) and Ti-Cr-Al Laves. The effective composition range of the two-phase system was determined to be 34.5–41.5 Ti, 49–53 Al, and 9.5–12.5 Cr (atomic percent).

Figure 1:
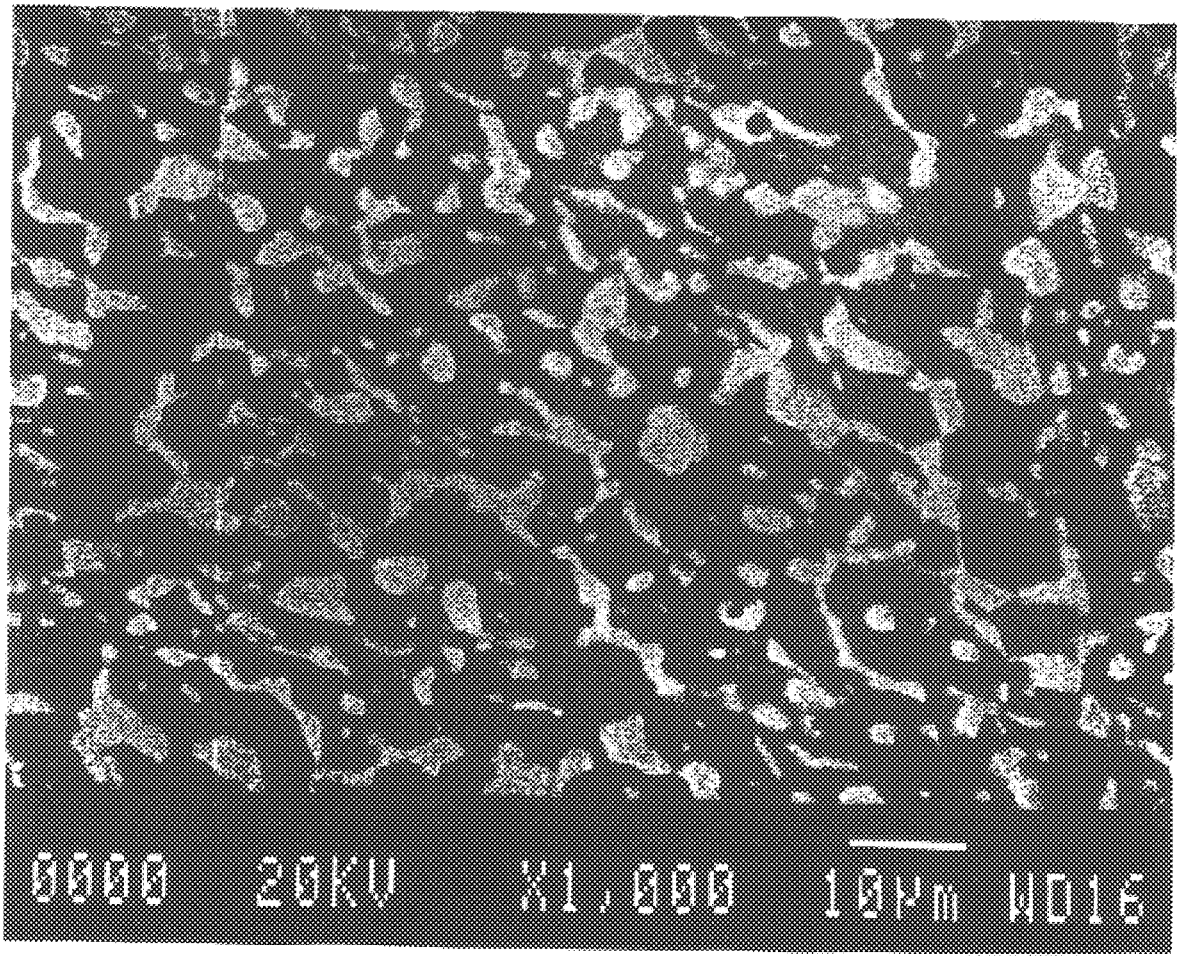
FIG. 1 is a micrograph of Ti-51.25Al-12.25Cr, which is an example of a gamma-based, gamma+Laves alloy, showing the gamma phase and the Laves phase.

FIG. 1 shows a micrograph of an example of an alloy 10 according to the present invention. Alloy 10 was produced by arc-melting and casting techniques as are known in the art. The composition of the alloy 10 is Ti-51.25Al-12.25Cr atomic percent. It should be noted that this example is used for illustrative purposes only and not by way of limitation to the invention. As shown in FIG. 1, the major volume fraction (greater than 0.50) of the alloy 10 comprises the $\gamma$ phase 16 and a minor volume fraction (less than 0.50) is attributed to the Laves phase 20. The term "gamma-based, gamma-Laves alloy" is ascribed to this type of composition wherein the volume fraction of TiAl ($\gamma$) exceeds 0.50. Microstructure evaluation of the alloy 10 reveals that the regions of the Laves phase 20 (light areas) are discontinuous within the $\gamma$ phase 16 (dark areas). As shown in the micrograph of FIG. 1, the regions of the Laves phase 20 are separated from each other by the $\gamma$ phase 16. It is believed that the discontinuity of the Laves phase 20 minimizes the brittle effect found in single Laves phase and Laves-based two-phase alloys, while the presence of the Laves phase 20 contributes to the oxidation resistance of the alloy 10.

The microstructures of the alloys of the present invention have been found to be stable from room temperature up to at least 1000° C. for the given composition range.

In addition, it has been found that the alloys of the present invention are both chemically and thermally compatible with the $\gamma+\alpha_2$ composite substrates due to the predominance of the $\gamma$ phase.

Figure 2:
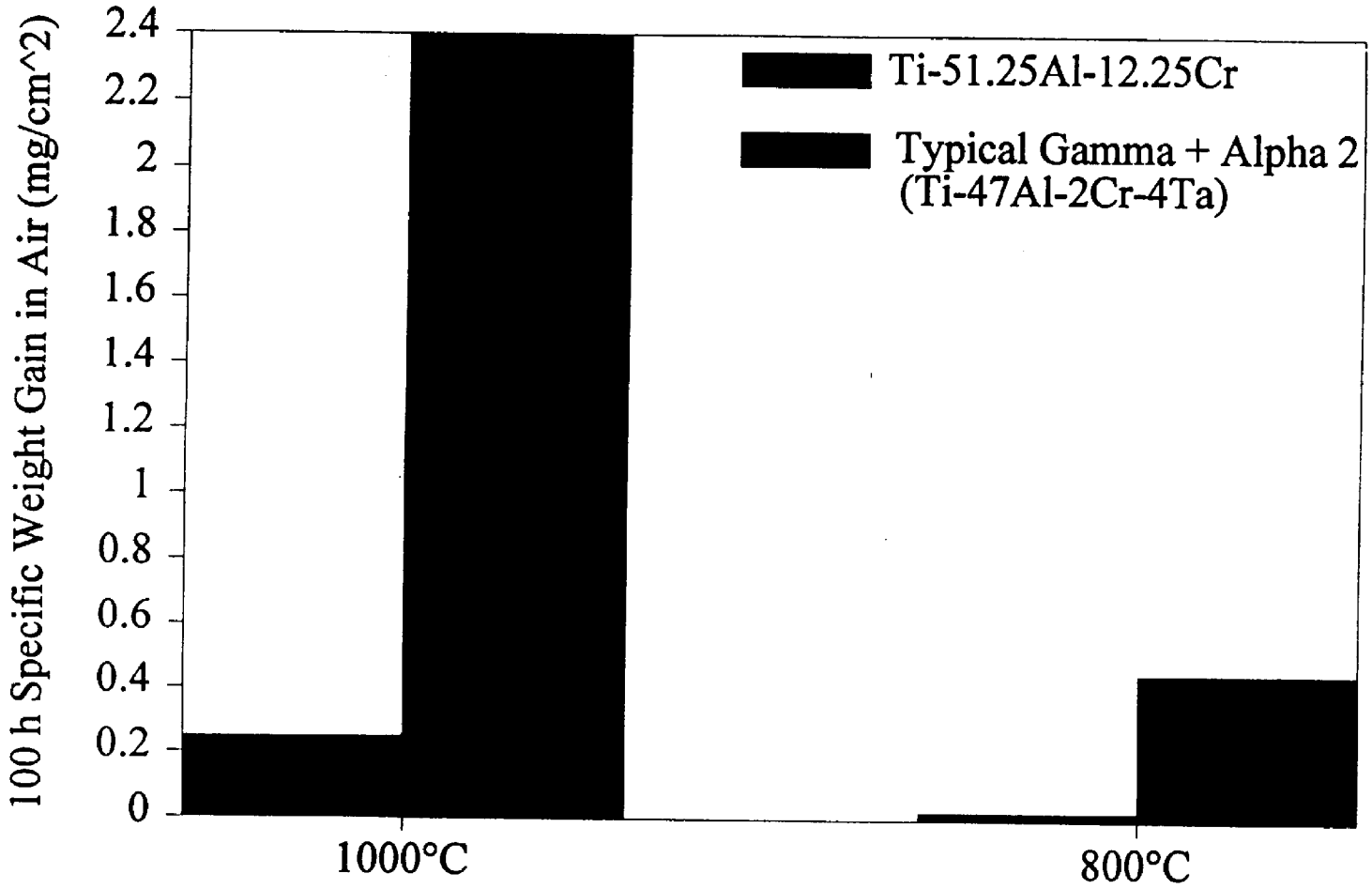
FIG. 2 is a bar graph showing oxidation weight gain for the gamma-based, gamma+Laves alloy Ti-51.25Al-12.25Cr and for a typical gamma+$\alpha_2$ alloy.

Oxidation resistance data for the example alloy 10 of FIG. 1 is given in FIG. 2 in terms of specific weight gain in air after 100 hours. Comparative data for a typical $\gamma+\alpha_2$ alloy (Ti-47Al-2Cr-4Ta) is also shown. It is evident from FIG. 2 that the alloys of the present invention provide superior oxidation resistance, especially at 1000° C. The oxidation resistance of the alloys is achieved by the formation of a continuous, protective alumina scale. Because the transport of interstitials, such as oxygen and nitrogen, across alumina is very low, the establishment of a continuous alumina scale also provides a barrier to the diffusion of oxygen/nitrogen into the alloy. This effectively reduces and/or eliminates interstitial embrittlement as well as providing oxidation resistance.

Figure 3:
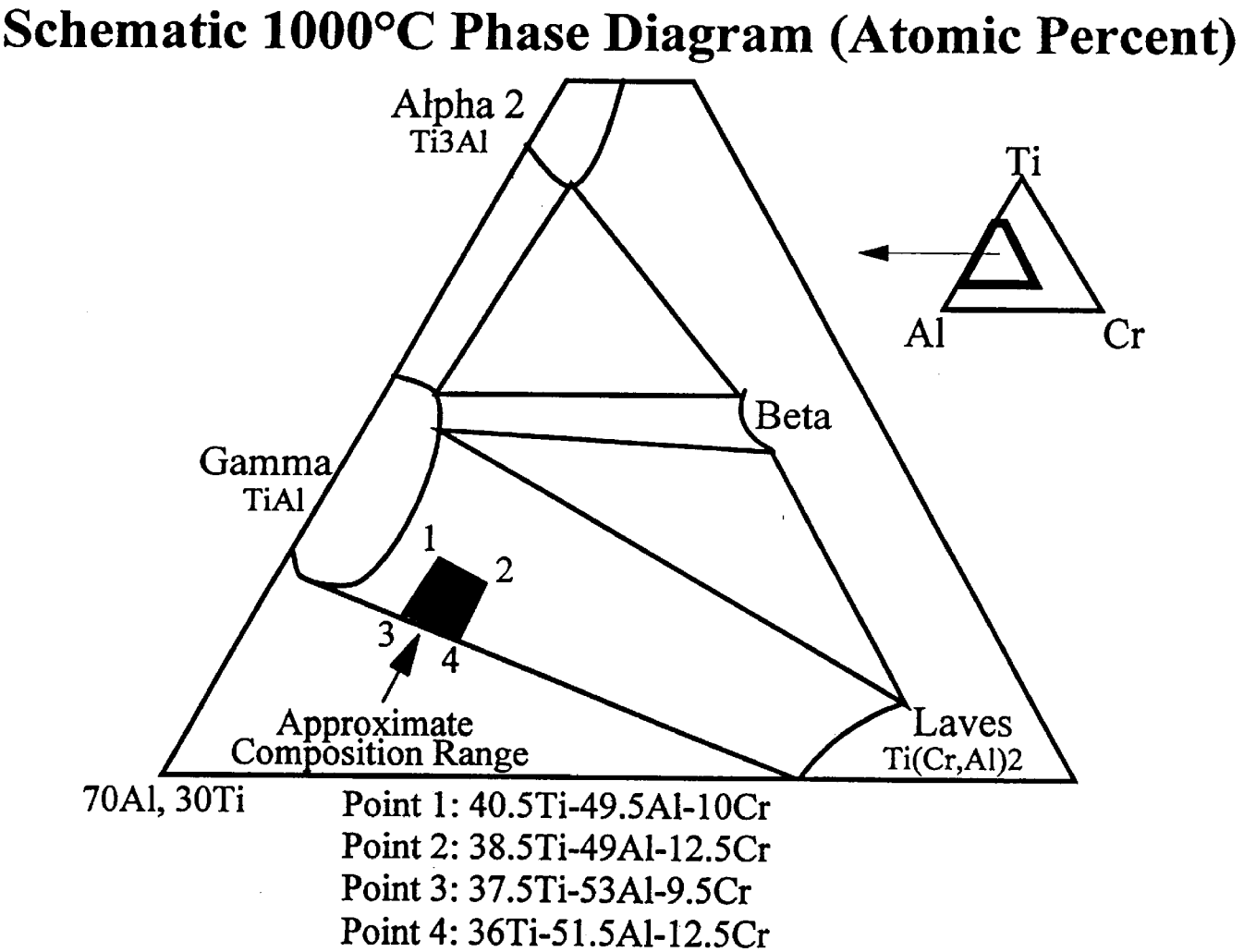
FIG. 3 is a phase diagram indicating the preferred composition range of gamma-based, gamma+Laves alloys of the present invention.

FIG. 3 represents a phase diagram indicating the preferred composition range of gamma-based, gamma+Laves alloys. Points 1, 2 and 3,4 fall on the same tie-lines, respectively. The tie-line defined by points 1,2 is at the Ti-rich edge of alumina-forming composition range. The tie-line defined by points 3,4 is at the Al-rich boundary of the gamma+Laves two-phase field. Compositions containing less Cr than that defined by points 1,3 start to lose their alumina-forming capability. They also solidify as a very coarse dendritic structure, and are therefore difficult to process. Compositions containing more Cr than that defined by points 2,4 begin to have too large a volume fraction of the Laves phase. This results in a microstructure in which the Laves phase is not surrounded by the gamma phase, which degrades cracking resistance.

Figure 4:
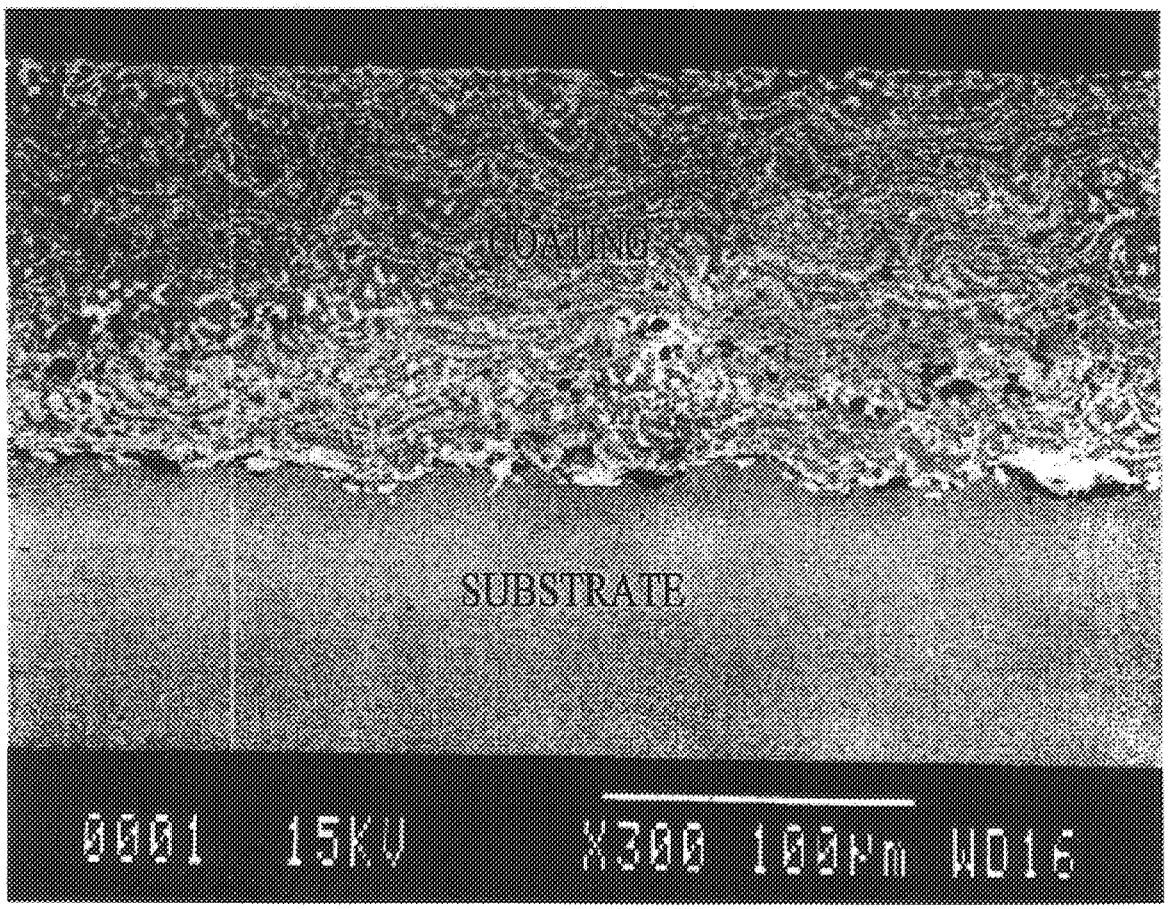
FIG. 4 is a micrograph of a Ti-51.25Al-12.25Cr coating applied to a typical $\gamma+\alpha_2$ substrate, Ti-48Al-2Cr-2Nb, by low pressure plasma spray (LPPS).
Figure 5:
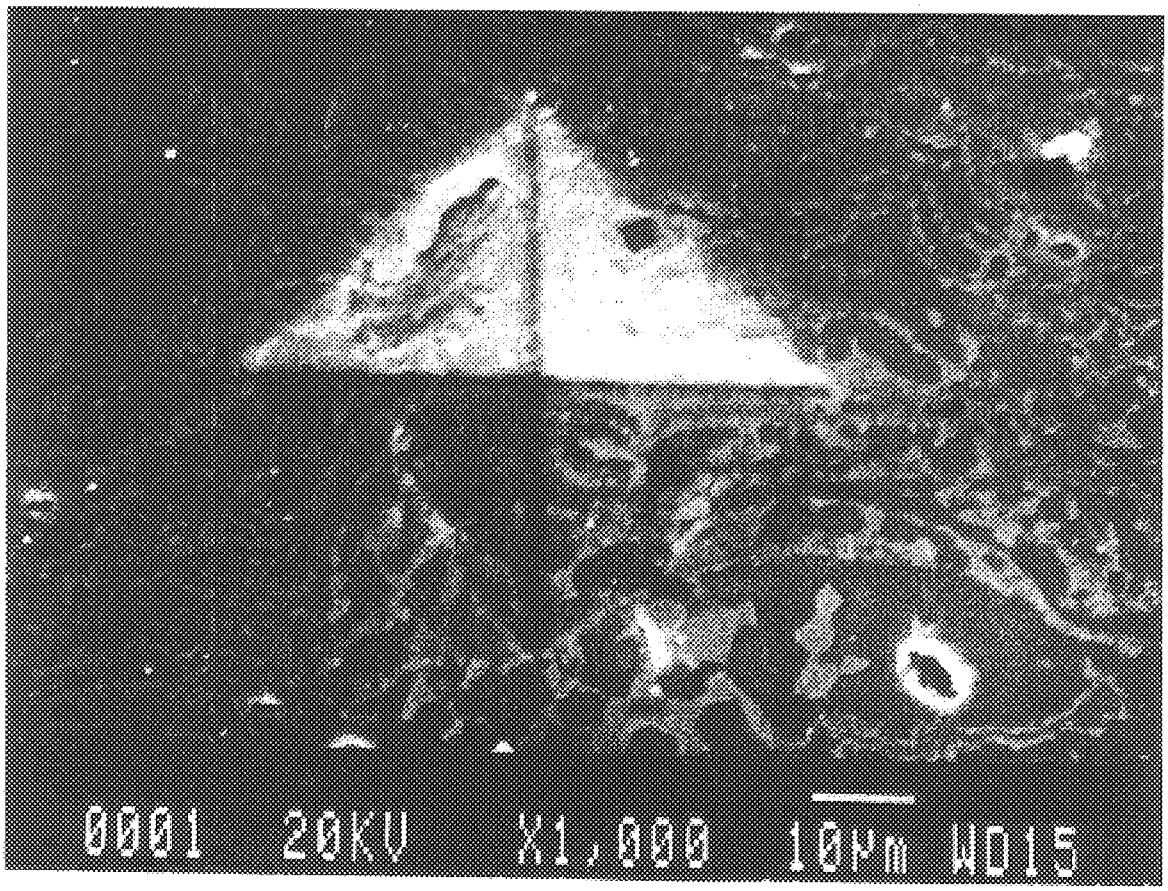
FIG. 5 is a close-up of the micrograph of FIG. 4.

FIGS. 4 and 5 are directed to micrographs of a Ti-51.25Al-12.25Cr coating 30 applied to a typical $\gamma+\alpha_2$ substrate 34, Ti-48Al-2Cr-2Nb, by low pressure plasma spray (LPPS). Other methods such as: sputtering, PVD, CVD, slurry processing, diffusion coating and other well-known techniques can be used. The darker regions indicate the gamma phase 38 and the lighter regions represent the Laves phase 40. FIG. 4 shows the sample after exposure at 1000° C. for 100 hours in air. FIG. 5 shows a closeup of the coating 30 after exposure at 1000° C. for 500 hours in air. The coating 30 is crack-free, and shows little interaction with substrate 34, which indicates excellent chemical and thermal compatibility. Room temperature Vicker's microhardness indent tests of the coating 30 shown in FIG. 5 at a 1 kg load for 15 seconds indicate that the coating 30 was very resistant to cracking. At this high load, cracking was sparse and limited to 1–2 micro-meters in length. At lower loads, no cracking was observed.

Figure 6:
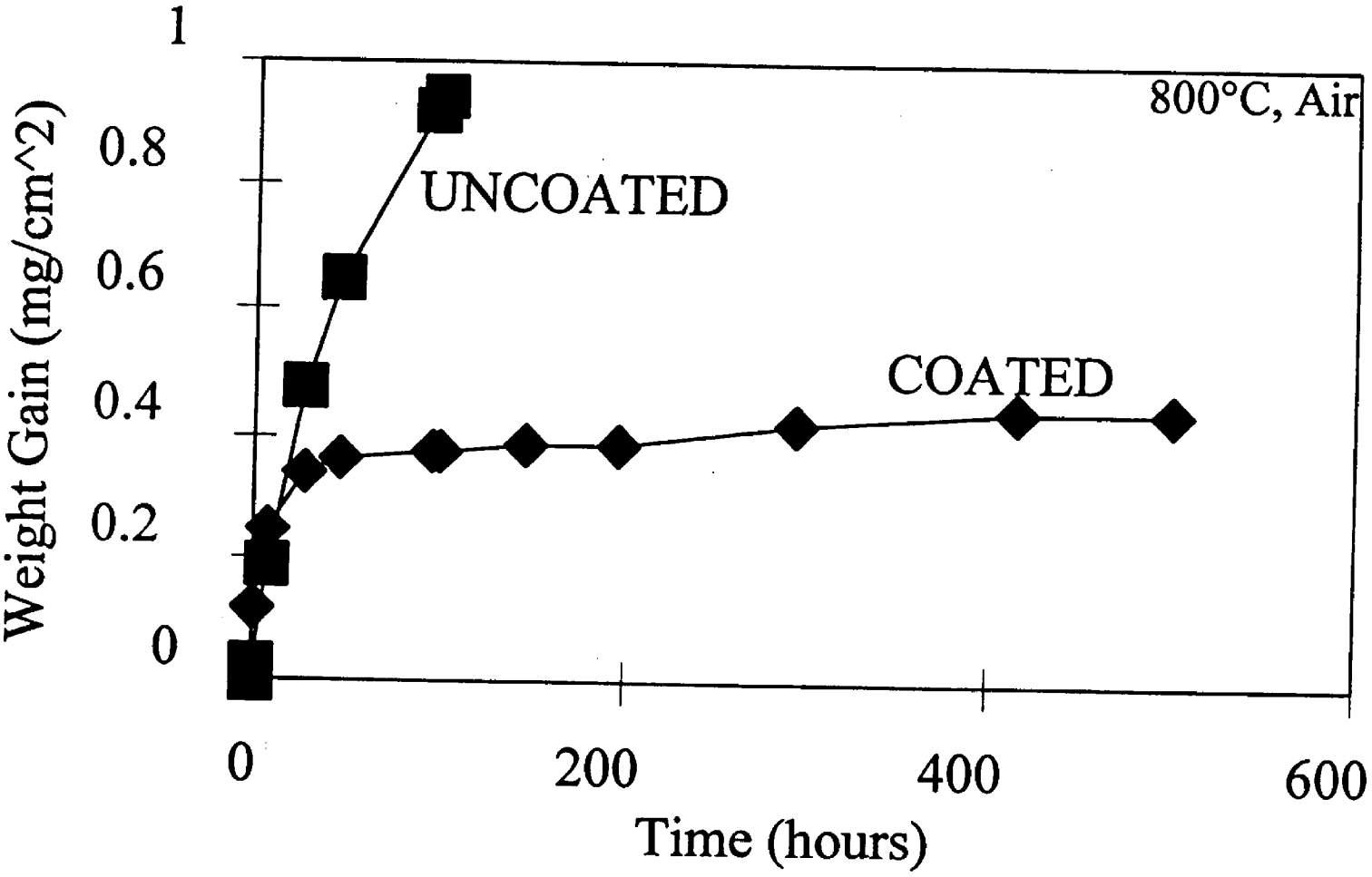
FIG. 6 is a graph of weight gain data for a coating on a $\gamma+\alpha_2$ substrate of the present invention at 800° C.
Figure 7:
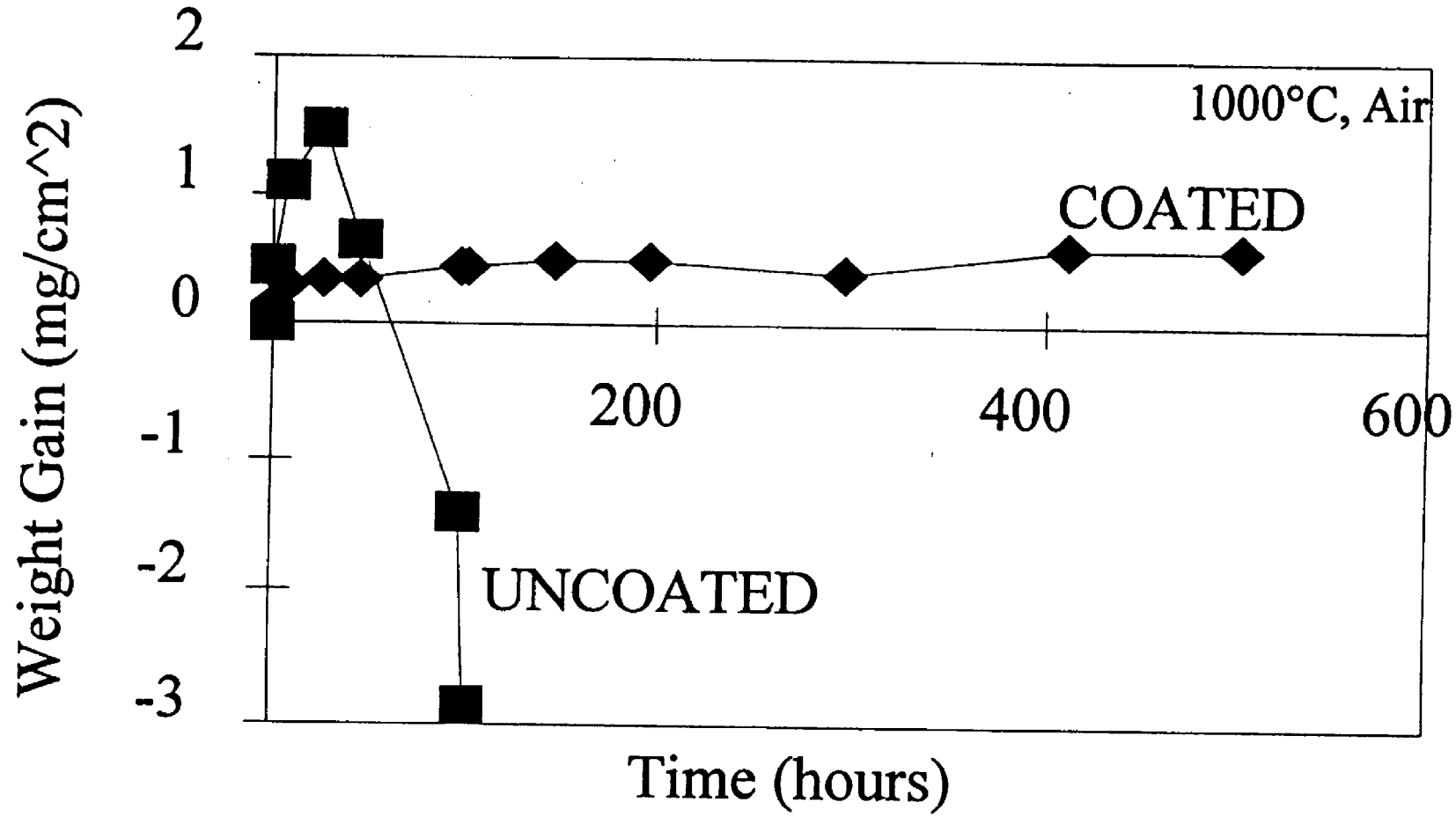
FIG. 7 is a graph of weight gain data for a coating of the present invention at 1000° C.

FIGS. 6 and 7 depict weight gain data for a LPPS Ti-51.25Al-12.25Cr coating on Ti-48Al-2Cr-2Nb at 800° C. and 1000° C. in air, respectively. At each data point, the sample was air cooled to room temperature, weighed, and returned to the test furnace. The weight gain data indicate that the coating successfully protected the substrate from oxidation. For this sample, only the major faces of the test coupon were coated. Edges and corners were left uncoated.

In an alternate use, the gamma-based, gamma+Laves alloys are also suitable oxidation and/or embrittlement resistant coatings for other titanium aluminide substrates such as $\alpha_2$-based or orthorhombic-based alloys; such as: $T_1$-24Al-11$N_B$ or $T_1$-22Al-23$N_B$, respectively.

In still another use, the gamma-based, gamma+Laves alloys are also suitable for coating alumina-based fibers to prevent matrix/fiber interactions in titanium-based metal matrix composites.

It will be apparent to those skilled in the art that the above methods may incorporate changes and modifications without departing from the general scope of this invention. It is intended to include all such modifications and alterations in so far as they come within the scope of the appended claims or the equivalents thereof.

Having thus described the invention, it is now claimed:

1. A chromium modified titanium aluminum alloy consisting essentially of titanium, aluminum, and chromium in the following approximate atomic ratio:

Ti(41.5–34.5)Al(49–53)Cr(9.5–12.5), wherein said alloy is a gamma based, gamma+Laves alloy having a volume fraction of TiAl (gamma) phase greater than 0.50 and a volume fraction of Ti-Cr-Al (Laves) phase less than 0.50.

2. The alloy of claim 1 wherein the approximate atomic ratio is:

Ti(36.50)Al(51.25)Cr(12.25).

3. The chromium modified titanium aluminum alloy of claim 1 wherein said Laves phase is discontinuous within said gamma phase.

4. A coating for a substrate, said coating consisting essentially of titanium, aluminum, and chromium in the following approximate atomic ratio:

Ti(41.5–34.5)Al(49–53)Cr(9.5–12.5), wherein said coating is a gamma based, gamma+Laves coating having a volume fraction of TiAl (gamma) phase greater than 0.50 and a volume fraction of Ti-Cr-Al (Laves) phase less than 0.50.

5. The coating of claim 4 wherein the substrate is a titanium aluminide alloy.

6. The coating of claim 5 wherein the titanium aluminide alloy is TiAl (gamma) titanium aluminide.

7. The coating of claim 5 wherein the titanium aluminide alloy is $Ti_3Al$ ($\alpha_2$) titanium aluminide.

8. The coating of claim 5, wherein the titanium aluminide alloy is a composite titanium aluminide comprising TiAl (gamma)+$Ti_3Al$ ($\alpha_2$).

9. The coating according to claim 4, wherein the substrate is an alumina-based fiber.

10. A composite structural article comprising a substrate and a coating for protecting the substrate from oxidative attack and interstitial embrittlement at temperatures up to at least 1000° C., the coating consisting essentially of titanium, aluminum, and chromium in the following approximate atomic ratio: Ti (41.5–34.5) Al (49–53) Cr (9.5–12.5); and wherein the coating comprises a volume fraction of TiAl gamma phase and a volume fraction of Ti-Cr-Al Laves phase said volume fraction of Gamma-TiAl being greater than 0.50.

11. An oxidation resistant chromium modified titanium aluminum alloy consisting essentially of titanium, aluminum, and chromium in the following approximate atomic ratio:

Ti(41.5–34.5)Al(49–53)Cr(10.5–12.5), wherein said alloy is a gamma based, gamma+Laves alloy having a volume fraction of TiAl (gamma) phase greater than 0.50 and a volume fraction of Ti-Cr-Al (Laves) phase less than 0.50, and wherein said alloy is applicable for use at temperatures between 600° C. and 1000° C.

* * * * *